US007905987B2

(12) United States Patent
Kennedy

(10) Patent No.: US 7,905,987 B2
(45) Date of Patent: Mar. 15, 2011

(54) PAPER SLUDGE PROCESSING FOR ANIMAL BEDDING

(75) Inventor: Patrick Kennedy, Denville, NJ (US)

(73) Assignee: Casella Waste Systems, Inc., Rutland, VT (US)

( * ) Notice: Subject to any disclaimer, the term of this patent is extended or adjusted under 35 U.S.C. 154(b) by 6 days.

(21) Appl. No.: 11/505,512

(22) Filed: Aug. 17, 2006

(65) Prior Publication Data

US 2008/0121361 A1 May 29, 2008

(51) Int. Cl.
*D21H 21/00* (2006.01)
*D21H 17/01* (2006.01)
*D21H 17/64* (2006.01)

(52) U.S. Cl. ..... 162/181.4; 119/172; 162/10; 162/158

(58) Field of Classification Search ..... 119/172; 162/10
See application file for complete search history.

(56) References Cited

U.S. PATENT DOCUMENTS

| | | | | |
|---|---|---|---|---|
| 2,649,759 | A | 8/1953 | Gibbs | |
| 4,129,094 | A * | 12/1978 | Stockel | 119/173 |
| 4,249,317 | A * | 2/1981 | Murdock | 34/93 |
| 4,343,751 | A * | 8/1982 | Kumar | 264/37.29 |
| 4,560,527 | A | 12/1985 | Harke et al. | |
| 4,607,594 | A * | 8/1986 | Thacker | 119/172 |
| 4,625,679 | A | 12/1986 | Hill | |
| 4,671,983 | A | 6/1987 | Burt | |
| 4,676,196 | A | 6/1987 | Lojek et al. | |
| 4,721,059 | A | 1/1988 | Lowe et al. | |
| 4,788,936 | A | 12/1988 | Billings | |
| 5,044,324 | A | 9/1991 | Morgan et al. | |
| 5,203,357 | A | 4/1993 | Vigliotti | |
| 5,209,186 | A | 5/1993 | Dewing | |
| 5,265,561 | A | 11/1993 | Crawford | |
| 5,358,187 | A | 10/1994 | Ward | |
| 5,536,371 | A * | 7/1996 | Verhoff | 162/189 |
| 5,593,542 | A | 1/1997 | Wolfer et al. | |
| 5,622,600 | A | 4/1997 | Smith et al. | |
| 5,728,270 | A * | 3/1998 | Knapick et al. | 162/189 |
| 5,763,083 | A | 6/1998 | Berrigan | |
| 5,807,465 | A | 9/1998 | Knapick et al. | |
| 5,882,480 | A | 3/1999 | Knapick et al. | |
| 5,888,345 | A | 3/1999 | Knapick et al. | |
| 5,897,700 | A * | 4/1999 | Manning | 106/697 |
| 5,951,822 | A | 9/1999 | Knapick et al. | |
| 5,964,187 | A | 10/1999 | Willis | |
| 6,019,873 | A | 2/2000 | Knapick et al. | |
| 6,092,302 | A | 7/2000 | Berrigan | |
| 6,214,465 | B1 | 4/2001 | Knapick et al. | |
| 6,276,300 | B1 | 8/2001 | Lewis, II et al. | |
| 6,276,619 | B1 | 8/2001 | Turk et al. | |
| 6,659,042 | B2 * | 12/2003 | Bloomer | 119/172 |
| 6,742,478 | B1 | 6/2004 | Davis | |
| 6,991,783 | B2 | 1/2006 | Santoiemmo | |
| 2003/0041808 | A1 | 3/2003 | Wulforst et al. | |
| 2005/0145355 | A1 | 7/2005 | Wester et al. | |
| 2005/0175577 | A1 * | 8/2005 | Jenkins et al. | 424/76.1 |
| 2005/0196593 | A1 | 9/2005 | Campbell et al. | |
| 2005/0263080 | A1 | 12/2005 | Campbell et al. | |

OTHER PUBLICATIONS

Purina Yesterday's News Small animal Bedding and Litter Product Page [downloaded from www.petsmart.com], downloaded on Feb. 2, 2009, Petsmart Corporation, whole document.*

Stutzman Environmental, Pet's Preference Critter Litter and Bedding [downloaded from archive.org], Dec. 20, 2005 [downloaded on Feb. 2, 2009], Stutzman Environmental, whole document.*

Yamamoto, Antibacterial characteristics and hydration resistance of calcium oxide with CaFe2O4 in grain, 2002, Journal of Material Sicience Letters, 21, p. 649 col. 1.*

* cited by examiner

*Primary Examiner* — Matthew J Daniels
*Assistant Examiner* — Anthony J Calandra
(74) *Attorney, Agent, or Firm* — Wilmer Cutler Pickering Hale and Dorr LLP

(57) ABSTRACT

A method for making an animal bedding fiber product, the method includes providing fiber from paper sludge, formulating the fiber in a mixture including a first desiccant agent including ash, so as to form a friable aggregate. Further, a fiber product including at least one short paper fiber from a secondary fiber, one or more inorganic fillers including kaolin clay; and a first desiccant agent including ash. Further still, a heatless process for making a fiber product including providing fiber from paper sludge, formulating the fiber in a non-active heat generating mixture including a first desiccant agent including ash, so as to form a waste fiber product.

9 Claims, No Drawings

PAPER SLUDGE PROCESSING FOR ANIMAL BEDDING

BACKGROUND OF THE INVENTION

1. Field of the Invention

The invention relates to an animal bedding fiber product that includes at least one short fiber having one or more inorganic fillers including kaolin clay and a first desiccant agent including ash. Further the invention relates to methods and processes for making an animal bedding fiber product, providing fiber from paper sludge and formulating the fiber in a mixture comprising ash as a first desiccant agent, so as to form a friable aggregate.

2. Discussion of Background Information

A significant problem associated with known animal bedding products has been to find materials that provide absorbency characteristics without resulting in adverse health effects for the animals. Additionally, certain conventional animal bedding materials have been identified as labor intensive and/or expensive. Furthermore, removal and disposal of used animal bedding products poses a concern.

Some of the most common problems associated with absorbency material used in animal bedding is the ammonia smell produced when the animal's urine contacts the animal's solid waste in the presence of oxygen. See U.S. Pat. No. 4,788,936. The effect of ammonia smell on the animals using the bedding can be linked to the animals' non-productivity, such as dairy cows producing less milk. For example, a common bedding material used for large animals (such as dairy cows) is straw, which is primarily used to separate the animal from its waste so the waste passes through the straw. Furthermore, when the straw bedding is exposed to the animal urine, it can result in odor problems, as mentioned earlier.

In addition, similar odor problems can be associated with other animal bedding materials such as wood chips, wood shavings, sawdust and wood pellets. These materials provide limited absorbency characteristics; while their use can emit odors, it may cause potential health issues to the animal, or result in substantial removal and disposal problems.

What is needed therefore is an absorbency material that can be used with the animal bedding without experiencing the disadvantages associated with known animal bedding products.

Paper mill sludge, generated from a virgin fiber source and/or a secondary fiber source, is a known absorbency material that has been used with animal bedding in the past. The terms "virgin fiber source" and "secondary fiber source" are discussed further below. Generally, paper mill sludge is a solid residue recovered from waste water during the pulping process; it is a clay-like material that consists of clays and short fibers. The paper mill sludge or residue generated from the pulping process are un-useable materials and are disposed of in landfills. Although the virgin papermaking process produces some paper mill sludge, the deinking (recycling) process produces far more paper mill sludge. For example, secondary fibers or recycled paper, such as newspapers, magazines and office paper waste can be used in the papermaking process (i.e., a deinking process). The recycled paper includes a significant amount of coated paper (i.e., laser print, photocopier print and ink), which results in primarily generating paper sludge. In particular, the paper sludge removed from coated papers during the above-noted pulping process is considered to be un-useable material and it is usually disposed of in landfills. Unlike secondary fibers, virgin fiber has never been used in the manufacture of paper or other products before and it does not include fillers from previously produced paper, such as recycled paper.

U.S. Pat. No. 4,788,936 discloses the use of paper mill sludge generated from a virgin fiber source that is used as an element to formulate animal bedding products. See Col. 1, lines 38-52 of U.S. Pat. No. 4,788,936. The sludge is treated with pellets formed from hard wood from the Poplar family, such as Aspen, which consists substantially of bark. The bark content of the pellets is between 5% and 40% by volume, with the balance being a combination of sawdust, ground wood chips, and ground lumber. However, as discussed earlier, known animal bedding materials such as wood chips, wood shavings, sawdust and wood pellets can result in odor problems associated with animal bedding. Also, as mentioned above, these materials provide limited absorbency capabilities, and their use can result in substantial removal or disposal problems. See Col. 1, lines 6-32 of U.S. Pat. No. 4,788,936. In addition, using paper mill sludge from a virgin fiber source and/or a secondary fiber source involves an expensive drying process. These can include belt dryers, vacuum dryers, fluid bed dryer, cylinder dyer or some other energy dependent mechanical drying device, such as waste heat or recovered heat from an existing process. These processes lower the moisture content suitable for making the animal bedding product. See U.S. Pat. No. 4,788,936.

U.S. Pat. Nos. 6,214,465 and 5,807,465 explain the use of paper mill sludge generated from a secondary fiber source, which is used as an element to formulate a granular floor absorbent product. The sludge used in both of these patents is processed similarly by utilizing waste paper that brakes up the pulp stock in a hydropulper and it is then screened. The paper fibers from the pulp stock are retained and sent for use in the paper making process. The solid material in the reject stream such as kaolin clay and inorganic materials pass through a flotation clarifier to separate the solids. The moisture in the slurry is then removed by means of a belt press to form a filter cake. The filter cake then enters a pin mixer where it is broken up into individual granules, and the granular floor absorbent product is formed. See Abstract of U.S. Pat. No. 5,807,465 and Col. 2, line 59 to Col. 4, line 67 of U.S. Pat. No. 6,214,465. However, the above-mentioned granular floor absorbent products are intended to be used as oil and water absorbents, such as pet litter or carriers for agricultural chemicals; they are not meant to be used for animal bedding. See Col. 2, lines 51-52 and Col. 6, lines 30-50 of U.S. Pat. No. 5,807,465 and Col. 2, lines 11-24 and Col. 5, lines 1-34 of U.S. Pat. No. 6,214,465. Furthermore, both of the above-mentioned processes require an expensive drying process, in order to kill bacteria and lower the moisture content to make the sludge suitable for making the granular floor absorbent product. See Col. 5, lines 12-67 of U.S. Pat. No. 5,807,465 and Col. 4, lines 28-50 of U.S. Pat. No. 6,214,465.

The prior art further explains the use of paper mill sludge generated from both a virgin fiber source and a secondary fiber source that is mixed with Cement Kiln Dust (CKD) and wood chips to formulate an animal bedding product. See Syracuse Fiber Recycling, LLC DEC permit No. 7-3115-00043/02001, issued by the New York State Dpartment of Environment Conservation, Division of Envioronment al Permits, Region 7, Syracuse N.Y. CKD is defined as a fine, raw material carried by hot gasses in a cement kiln and collected by a filter system during the production of cement. The CKD differs from cement in that the raw material hasn't been fully burnt. In particular, CKD is created during the third stage of cement manufacturing. Electrostatic and bag filters capture the dust for recycling. The industry recycles more than 75 percent of the cement kiln dust directly back into the cement kiln as raw material. Recycling this byproduct also reduces the need for limestone and other raw materials and helps conserve energy. Other uses for CKD include agricultural soil benefaction and soil stabilization. Generally, CKD can be used as an alternative to lime, e.g., a lime agent and/or as a material having similar pH properties.

However, with increasing costs and decreasing availability of landfill space, it has become beneficial to find alternative uses for the paper mill sludge. In addition, the use of paper mill sludge from a virgin fiber source and/or a secondary fiber source requires an expensive drying process. These can include belt dryers, vacuum dryers, fluid bed dryer, cylinder dyer or some other energy dependent mechanical drying device, such as waste heat or recovered heat from an existing process in order to lower the moisture content suitable for making the animal bedding product. See U.S. Pat. Nos. 4,788,936 and 6,214,465.

Thus, what is needed is an absorbent material that does not require an expensive formulation process to make an animal-bedding product. Furthermore, a process that can use paper mill sludge for an animal-bedding product is needed to reduce the amount of paper mill sludge disposed in landfills.

SUMMARY OF THE INVENTION

The present invention is directed to a method for making an animal bedding fiber product. The method includes providing fiber from paper sludge, formulating the fiber in a mixture having a first desiccant agent including ash, thereby form a friable aggregate.

According to another feature of the invention, the animal bedding fiber product can be made from paper sludge generated from a virgin paper source and/or a secondary fiber source, e.g., recycled waste paper. Further, the ash may be derived from one or more materials from a group consisting of straw, peat, wood, trash, paper and a coal by-product of coal combustion. Further still, the fiber from the paper sludge may include short paper fiber and/or long paper fiber. According to an aspect of the present invention, the method can be heatless.

According to another feature of the invention, the fiber may be from a group consisting of at least a portion of a mill residual, an inorganic filler, a kaolin clay, a calcium carbonate, a cellulose fiber and an organic material or any combination thereof. Further, the method may include formulating the fiber in a mixture having at least one antibacterial agent, i.e., lime. Further still, the method may comprise of formulating the fiber in a mixture having at least one coloring agent. It is possible the method may include formulating the fiber in a mixture having at least one odor enhancing agent, at least one odor neutralizing agent and/or at least one odor reducing agent. The method may further include formulating the fiber in a mixture having an odor concealing chemical agent. It is possible the method may comprise of formulating the fiber in a mixture having at least one bacteria reducing agent. Further still, the method may include formulating the fiber in a mixture having at least one antimicrobial agent.

According to another feature of the invention, the method may comprise of a second desiccant agent. For example, the second desiccant agent can be from a group consisting of sawdust, straw, peat moss, wood shavings, rice hulls, sugar cane, at least a portion of cardboard, diatomaceous earth corn, sand, gypsum, cotton seed hulls, tomato pumice or any combination thereof. Further, the method may include formulating the fiber in a mixture having at least one eating deterrent agent, so as to prevent an animal from consuming the fiber product. Further still, the method may comprise of formulating the fiber in a mixture including at least an insect repellant and/or an insecticide. It is possible the method may further comprise of formulating the fiber in a mixture including at least one fire retardant agent.

In an alternative embodiment of the invention, a fiber product can have at least one short paper fiber from a secondary fiber, one or more inorganic fillers including kaolin clay and a first desiccant agent including ash.

According to another feature of the invention, the fiber product can include at least one short paper fiber from recycled pulp. Further, the fiber product may include ash that is derived from one or more materials from a group consisting of straw, peat, wood, trash, paper and a coal by-product of coal combustion. It is possible the fiber product may comprise of at least one antibacterial agent, i.e., lime. Further, the fiber product may further comprise of at least one coloring agent. Further still, the fiber product may include at least one odor enhancing agent, at least one odor neutralizing agent and/or at least one odor reducing agent. The fiber product may comprise of at least one odor concealing chemical agent. Further, it is possible the fiber product may include at least one bacteria reducing agent and/or at least one antimicrobial agent.

According to another feature of the invention, the fiber product may comprise of a second desiccant agent. For example, the second desiccant agent may be from a group consisting of sawdust, straw, peat moss, wood shavings, rice hulls, sugar cane, at least a portion of cardboard, diatomaceous earth corn, sand, gypsum, cotton seed hulls, tomato pumice and any combination thereof.

According to another feature of the invention, the fiber product may be characterized as an organic absorbing material, so as to absorb oil, water and waste discharged from an animal. It is possible the fiber product can include at least one animal eating deterrent agent, so as to prevent an animal from consuming the fiber product. It is possible the fiber product may have at least one insect repellant agent and/or at least one insecticide agent or any combination thereof. Further, the fiber product may include at least one fire retardant agent. Further still, the coal ash used in the fiber product may be conditioned coal ash and/or non-conditioned coal ash or any combination thereof.

According to an alternative embodiment of the invention, a heatless process for making a fiber product that provides fiber from paper sludge, formulating the fiber in a non-active heat generating mixture including a first desiccant agent including ash, thereby forming a waste fiber product.

According to another feature of the invention, the heatless process includes ash that may be derived from one or more materials from a group consisting of straw, peat, wood, trash, paper and a coal by-product of coal combustion. Further, the fiber can include a short paper fiber and/or a long paper fiber or any combination thereof. Further still, the fiber may consist of at least a portion of clay and/or a calcium carbonate. It is possible the fiber can be from paper sludge that is from at least a portion of virgin wood pulp and/or secondary fiber. Further, the heatless process may include mixing into the mixture an antibacterial agent and/or a second desiccant agent.

According to an alternative embodiment of the invention, a heatless process for making a fiber product that provides a waste fiber from a recycled waste fiber source, formulating the waste fiber in a mixture including a first desiccant agent having ash, thereby forming a recycled waste fiber product.

According to another feature of the invention, the heatless process may include ash derived from one or more materials from a group consisting of straw, peat, wood, trash, paper and a coal by-product of coal combustion. Further, the heatless process may include formulating the fiber in a non-active heat generating mixture.

According to an alternative embodiment of the invention, a heatless process for making an animal bedding fiber product that provides a fiber from a fiber source, formulating the fiber in a mixture including a first desiccant agent having ash, thereby forming a friable aggregate.

According to another feature of the invention, the heatless process may include ash that is derived from one or more materials from a group consisting of straw, peat, wood, trash, paper and a coal by-product of coal combustion.

According to another feature of the invention, the heatless process may include fiber that is a waste fiber. Further, the heatless process may include formulating the fiber in a non-active heat generating mixture.

According to an alternative embodiment of the invention, an animal bedding fiber product that includes one or more inorganic solid having a paper-based material, one or more organic solid including a plurality of fibers and a first desiccant agent including ash, thereby forming the animal bedding fiber product.

According to another feature of the invention, the ash can be derived from one or more materials from a group consisting of straw, peat, wood, trash, paper and a coal by-product of coal combustion. Further, the plurality of fibers from the organic solid may comprise of a short paper fiber and/or a long paper fiber or any combination thereof. Further still, the animal bedding fiber product may include at least a portion of a mill residual, an inorganic filler, and/or a kaolin clay. It is possible the animal bedding fiber product may include at least a portion of a calcium carbonate, a cellulose fiber, an organic material or any combination thereof. Further, the animal bedding fiber product may include one or more materials from a group consisting of alfalfa, one or more grasses containing chlorophyll and/or divided paper, wood flour, saw dust and cotton seed hulls, tomato pumice, sand, ground rock, baking soda and/or any mixtures thereof.

Other exemplary embodiments and advantages of the present invention may be ascertained by reviewing the present disclosure.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description making apparent to those skilled in the art how the several forms of the present invention may be embodied in practice.

The present invention is directed to a method for making an animal bedding fiber product. The method includes providing fiber from paper sludge, formulating the fiber in a mixture including a first desiccant agent including ash, and thereby forming a friable aggregate.

According to an aspect of the invention, the paper sludge used in the present invention can come from different types of mills, by non-limiting example, Kraft mill, sulfite mill and a deinking mill. Further, the paper sludge used in the present invention can be composed of different types of compositions which may depend on several factors, such as: 1) the types raw materials used; 2) the processes employed, i.e., different grades of paper, such as unbleached, newsprint, tissue, printing, writing, office and specialty papers; and 3) the final products made. Further still, it is possible the present invention may use sludge from other mixtures of plant fibrous material such as sugar beet, rice hulls, sugar cane, citrus pulp, grain and potato. Further, the present invention may use sludge from pulp derived from grasses, hemp, bamboo and straw or other like materials.

Generally, the above-noted mills generate paper sludge during the mill process, after raw materials have been cooked with chemicals to release cellulose fibers as well as to dissolve lignin, such that the impurities (or paper sludge) can be removed from the waste water during washing.

According to an aspect of the invention, the paper sludge used in the present invention can be generated from a secondary fiber source or recycled wastepaper. In particular, the term secondary fiber source can be understood as fibers not from a virgin fiber source. The term virgin fiber source may be considered fibers used for the first time after harvesting that are processed to make some product. However, fibers from a secondary fiber source can be fibers used for a second time, which is processed to make a product, i.e., fibers from recycled paper.

The paper sludge generated from the secondary fiber source, as for example, can be characterized as a solid residue or a clay-like material consisting of clays and particles of ink and fibers, i.e., fibers too short to be converted into a finished paper product. It is possible the paper sludge includes mostly short paper fibers and some long paper fibers, or some combination thereof. For example, recycled paper (newspapers, magazines and office paper waste) can be used in the papermaking process (i.e., a deinking process), such that the recycled paper includes a significant amount of coated paper (i.e., laser print, photocopier print and ink), which results in mostly generating paper sludge. In particular, the paper sludge removed from coated papers during the above-noted pulping process is considered un-useable material and usually disposed in landfills.

However, it is possible the instant invention may use paper sludge (from the secondary fiber source or fibers used for a second time in the pulping process) that mostly has long paper fibers with some short paper fibers or some combination thereof. As mentioned-above there are many different types of mills producing many different types of products, all of which may be using different fiber lengths for producing the different types of products. It is possible some milling process standards characterize fiber lengths differently, such that some milling process standards may refer to a certain fiber length as long, whereas another milling process standard may refer to the same fiber length as short. Thus, it is possible depending on which milling process standard being referred that paper sludge generated from a secondary paper source can have mostly long fibers and some short fibers or some combination thereof.

According to an aspect of the invention, the paper sludge used can be from the pulping process from a virgin paper source. For example, solid materials collected and/or rejected during the pulping process may become part of the paper sludge, such as large pieces of fiber, small bundles of fibers not separated completely during pulping, knots, inorganic contaminants and uncooked chips. Further, it is also possible paper sludge may consist of waste generated prior to the operation of the pulping system (for either a virgin paper source or secondary paper source), due to maintenance of pulping systems. Further still, the paper sludge may consist of waste from unexpected events resulting in depositing inorganic and/or organic waste into the pulping process (for either a virgin paper source or secondary paper source). It is possible the above-mentioned sludge may include portions of external waste, which may or may not have been purposely added to the pulping system by operation personal or a third party.

According to an aspect of the invention, the paper sludge can be mixed with a desiccant agent that includes ash derived from materials such as straw, peat, wood, trash, paper and a coal by-product of coal combustion. For example, the paper sludge can be combined with different forms of coal ash referred to as fly ash (i.e., a very fine powder material that is carried with the stack gases and is collected by electrostatic precipitators or a baghouse prior to exiting the stack) and bottom ash (i.e., can be much coarser than fly ash having an almost sand-like material that is sluiced from the bottom of the boilers). Further, the coal ash may be a by-product from a particular type of coal or be in combination with any other types of coal, such as, coking coals, jurassic coals, triassic coals, permian coals, carboniferous coals, to name a few. Further still, the above-mentioned coal ash may include portions of other types of materials, which may be mixed into the coal prior to the coal combustion. In particular, in a co-generation power system two or more fuels are used, such that coal may be combined with other fuel sources to power the co-generation power system. For example, the alternate fuel sources may include cane residue (bagasse in sugar cane), straw, peat, wood, wood chips, bio-waste, petroleum, coke, crude oil, heavy residual oil, trash, sewage, orimulsion (bituminous coal). Some of the possible benefits in using coal ash may be as an absorbant material to dry out paper sludge, or as a coloring agent and/or as an odor reducing agent.

According to an aspect of the invention, the paper sludge and coal ash mentioned-above may be mixed by a mixer including a mechanical mixer run by a fuel source and/or a non-fuel source, i.e., human and/or animal power. Further, after the mixing of the paper sludge and coal ash, the present invention may form a friable aggregate (i.e., a solid that can easily be crumbled into powder or small particles). It is possible the present invention, among other things, may result in forming a fiber product having particles that are soft and pliable due to the level of moisture content within the particles. Further, the present invention may provide for a fiber product having a substantially uniform density throughout the particles.

According to another embodiment of the invention, it is possible the mixer can include an impeller (either vertical, horizontal or any combination thereof) that mixes the paper sludge and coal ash in a heatless mixture or a mixture without applying an active heating, i.e., heating that is generated mechanically (i.e., fans, blowers, etc.), electromagnetic dissipation (i.e., man-made electronic systems, such as rays, gamma rays, x-rays, ultraviolet light, visible light, infrared light, radar, microwaves, and all electronic transmission systems), mechanical dissipation, or by some other man-made mechanical heat-generation process. As mentioned above, the term "heatless mixture" is understood as a mixture without applying an active heating (as defined above). According to the method of the instant invention the mixing process does not include heating by an oil, coal and petroleum. It is possible the method according to an aspect of the instant invention may include a process for drying using solar heat and/or methane.

According to another embodiment of the invention, the mixer (or at least a part of the mixer) may be exposed to solar rays from the sun, so as to provide a drying effect for the paper sludge and coal ash. Further, the mixer may be arranged with another device or by itself or any combination thereof, so as to provide a drying effect, wherein the materials to be mixed (paper sludge and coal ash) move from one location to another location. It is possible the mixer utilizes a drying effect by gravity, wherein the coal ash and paper sludge are at least partially dried from falling from one location to another location.

According to another embodiment of the invention, the paper mill sludge may consist of mill residual, an inorganic filler, a kaolin clay, a calcium carbonate, a cellulose fiber and an organic material. Further, the finished fiber product may contain an organic fraction that may be composed of cellulose fiber, carbon and coal ash.

According to another embodiment of the invention, the product of the instant invention may include formulating the fiber in a mixture including at least one antibacterial agent, such as lime or materials having similar characteristics to lime. It is possible the mixing of coal ash with lime can produce an exothermic reaction adding at least some heat to the mixture during the mixing process. A possible advantage to mixing lime with the coal ash may be in reducing bacteria and/or killing bacteria that may lead to negative health issues for animals, such as mastitis on cow udders. Further, the above-mentioned antibacterial agent may include materials having characteristics with high pH levels that are non-toxic, natural or man-made, reduce bacteria and do not affect an animal's health. Further, the product of the instant invention may include formulating the fiber in a mixture including at least one odor enhancing agent, odor neutralizing agent, odor reducing agent and an odor concealing chemical agent. It is possible the finished product of the instant invention may include formulating the fiber in a mixture including a coloring agent. Further still, the product may include at least one bacteria reducing agent and at least one antimicrobial agent.

According to another embodiment of the invention, the product of the instant invention may include a second desiccant agent, wherein the second desiccant agent is one of sawdust, straw, peat moss, wood shavings, rice hulls, sugar cane, at least a portion of cardboard, diatomaceous earth, corn, sand, gypsum, cotton seed hulls, tomato pumice and any combination thereof.

According to another embodiment of the invention, the product of the instant invention may include formulating the fiber in a mixture including at least one eating deterrent agent, so as to prevent an animal from consuming the fiber product. Further, the product may include formulating the fiber in a mixture including at least one an insect repellant, insecticide and/or fire retardant agent.

According to another embodiment of the invention, the instant invention may include a fiber product including: 1) at least one short paper fiber from recycle pulp and/or secondary fiber; 2) one or more inorganic fillers including kaolin clay; and 3) a first desiccant agent including coal ash. Further, the fiber product may include: 1) at least a portion of one of a mill residual; 2) an inorganic filler; 3) a kaolin clay; 4) a calcium carbonate; 5) a cellulose fiber; 6) an organic material, and any combination thereof. It is possible the fiber product can include one of alfalfa, one or more grasses containing chlorophyll, divided paper, wood flour, saw dust, cotton seed hulls, tomato pumice, sand, ground rock, baking soda and mixtures thereof. The fiber product according to the invention may include an organic absorbing material, so as to absorb one of oil, water and waste discharged from an animal. The fiber product according to the invention may include conditioned coal ash and/or non-conditioned coal ash and any combination thereof.

It is noted that the foregoing examples have been provided merely for the purpose of explanation and are in no way to be construed as limiting of the present invention. While the present invention has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for making a fiber product utilizing a mechanical mixer, comprising:

a) providing fiber from paper sludge derived from at least a portion of one of virgin wood pulp and secondary fiber, wherein said sludge further comprises at least one of an inorganic filler, a kaolin clay, and a calcium carbonate;

b) combining an antibacterial agent, wherein said agent includes materials having a high pH level and that are non-toxic;

c) combining the materials in steps a) and b) with a first desiccant including at least one of coal ash and bottom ash, wherein the coal ash includes coal by-product from coal combustion and wherein the bottom ash is derived from one or more materials from a group consisting of straw, peat, wood, trash, and paper;

d) mixing the mixture of step c) with the mechanical mixer without applying an active heating, wherein the active heating is defined as heating generated mechanically by at least one of blowers and/or fans, electromagnetic dissipation, wherein the electromagnetic dissipation is at least one of man-made electronic systems, gamma rays, x-rays, ultraviolet light, visible light, infrared light, radar, microwaves, and all electronic transmission systems, mechanical dissipation, by other man-made mechanical heat-generation process, or heating by an oil, coal and petroleum, and thereby forming a waste fiber product; during the mixing process drying the mixture by a combination of exposing the mixture to methane based drying, solar rays from the sun and gravity, wherein the mixture is at least partially dried from falling from one location to another location;

e) producing an exothermic reaction as a result of the mixture of the combination of the materials in steps a), b), and c);

f) combining the mixture with a second desiccant comprising at least one of sawdust, straw, peat moss, wood shavings, rice hulls, sugar cane, at least a portion of cardboard, diatomaceous earth, corn, sand, gypsum, and cotton seed hulls;

g) producing, using the mixture produced by the non-active heating process and the drying mixture process, a fiber product having particles that are soft and pliable in accordance with a moisture level of the particles;

h) combining with the mixture at least one of an odor enhancing agent, odor neutralizing agent, odor reducing agent and an odor concealing chemical agent, and color agent.

2. The process according to claim 1, wherein the paper sludge comprises at least a portion of one of clay and a calcium carbonate.

3. The process according to claim 1, wherein the fiber product has substantially uniform density throughout the particles.

4. The process according to claim 1, wherein the fiber product further comprises at least one of an animal eating deterrent, insect repellant, insecticide and fire retardant.

5. The process according to claim 1, wherein the antibacterial agent may include lime.

6. A process for making an animal bedding fiber product, comprising:

a) providing fiber from a fiber source derived from at least a portion of one of virgin wood pulp and secondary fiber, wherein said sludge further comprises at least one of inorganic filler, a kaolin clay, and a calcium carbonate;

b) combining an antibacterial agent, wherein said agent includes materials having a high pH level and that are non-toxic;

c) combining the materials in steps a) and b) with a first desiccant including at least one of coal ash and bottom ash, wherein said bottom ash is derived from one or more materials from a group consisting of straw, peat, wood, trash, and paper;

d) mixing the mixture of step c) with the mechanical mixer without applying an active heating, wherein the active heating is defined as heating generated mechanically by at least one of blowers and/or fans, electromagnetic dissipation, wherein the electromagnetic dissipation is at least one of man-made electronic systems, gamma rays, x-rays, ultraviolet light, visible light, infrared light, radar, microwaves, and all electronic transmission systems, mechanical dissipation, by other man-made mechanical heat-generation process, or heating by an oil, coal and petroleum, and thereby forming a waste fiber product; during the mixing process drying the mixture by a combination of exposing the mixture to methane based drying, solar rays from the sun and gravity, wherein the mixture is at least partially dried from falling from one location to another location;

e) producing an exothermic reaction of the mixture as a result of the combination of the materials in steps a), b), and c);

f) combining the mixture with a second desiccant comprising at least one of sawdust, straw, peat moss, wood shavings, rice hulls, sugar cane, at least a portion of cardboard, diatomaceous earth, corn, sand, gypsum, and cotton seed hulls;

g) producing, using the mixture, an animal bedding fiber product having particles that are substantially uniform density throughout the particles; and h) combining with the mixture at least one of an odor enhancing agent, odor neutralizing agent, odor reducing agent and an odor concealing chemical agent, and color agent.

7. The process according to claim 6, wherein the fiber is waste fiber.

8. The process according to claim 6, wherein the paper sludge comprises at least a portion of one of clay and a calcium carbonate.

9. The process according to claim 6, wherein the particles of the animal bedding fiber product is at least one of soft and pliable in accordance with the moisture content of the particle.

* * * * *